United States Patent [19]

McIntosh

[11] 3,985,216

[45] Oct. 12, 1976

[54] THERMAL PRINT HEAD ASSEMBLY

[75] Inventor: Robert McIntosh, Nashua, N.H.

[73] Assignee: Centronics Data Computer Corporation, Hudson, N.H.

[22] Filed: Apr. 14, 1975

[21] Appl. No.: 567,602

[52] U.S. Cl. ..... 197/1 R; 346/76 R; 219/216

[51] Int. Cl.[2] ..... B41J 3/04

[58] Field of Search ..... 197/1 R; 346/76 R, 1 R, 346/141, 139 R; 219/216; 101/93.04, 93.05, 21, 27, 31

[56] References Cited

UNITED STATES PATENTS

| | | | |
|---|---|---|---|
| 1,770,493 | 7/1930 | Ranger | 346/1 R |
| 3,139,026 | 6/1964 | Meckstroth et al. | 101/93.04 |
| 3,300,017 | 1/1967 | Yazejian et al. | 197/1 R |
| 3,690,431 | 9/1972 | Howard | 197/1 R |
| 3,777,116 | 12/1973 | Brescia et al. | 219/216 |
| 3,842,957 | 10/1974 | Wilkin et al. | 219/216 X |

*Primary Examiner*—Ralph T. Rader

*Attorney, Agent, or Firm*—Ostrolenk, Faber, Gerb & Soffen

[57] ABSTRACT

A thermal print head assembly preferably for use with temperature sensitive impression material in a dot-matrix line printer includes a housing having a plurality of electrically actuatable means for impinging upon the impression material; means for guiding each of the plurality of impinging means to form a straight line at the housing front end and adjacent the impression material; and electrical means positioned within the housing for heating the impinging means without interfering with their movement through the frong housing end and being insulated from the housing to prevent excessive heating thereof. In a preferred embodiment, the electrical heating means is energized simultaneously with the motor of the line printer to maintain the forward ends of the impinging means at a temperature of the order of 300°F. to allow printing on thermally activated paper.

10 Claims, 2 Drawing Figures

THERMAL PRINT HEAD ASSEMBLY

BACKGROUND OF THE INVENTION

The present invention relates to electrical data printers and more particularly to a novel thermal print head assembly for forming characters preferably upon a temperature sensitive impression medium in a dot-matrix type line printer.

It is well-known in the line printer art to use a print wire actuated by a solenoid to impinge upon an inked ribbon to form a dot upon a paper document, such as a sheet of paper. An advanced form of line printer utilizes a plurality of such print wires arranged along a straight line substantially parallel to an edge of the paper to simultaneously print a column containing a first number of dots; the print head containing the plurality of print wires and their actuating solenoids is moved across the paper to print a plurality of dot columns (typically five in number) to form a dot matrix pattern representing a character, number, symbol, or segmented pattern. Characters, numerals and symbols are typically formed within a 5 × 7 dot matrix. Lines of characters are formed in this manner.

In a typical application, a line usually consists of either 80 or 132 characters; each character consisting of 5 dot columns, each column containing typically seven dots. In such a dot-matrix line printer, the inked ribbon must be positioned to be impacted by all seven print wires. Each print wire impacts the inked ribbon a large number of times for each line, e.g. a total of 400 possible impacts for an 80 column line printer. The inked ribbon is thus subjected to rapid wearing and deterioration. As the inked ribbon wears the sharpness of dots is significantly reduced. The proper sharpness of dot patterns, therefore, requires that the ribbon either be re-inked at frequent intervals — a process unduly messy and complicated — or that the ribbon be changed at frequent intervals — a time consuming process requiring removal of the line printer from active service.

SUMMARY OF THE INVENTION

It is desirable to use a thermal, i.e. heat activated, impression medium to thereby completely dispense with the need for an inked ribbon and its associated guide mechanism. The print head assembly must maintain the print wire tips at a sufficiently high temperature to allow the thermal impression medium to be activated to form a high contrast dot responsive to each activation of each print wire driving solenoid.

In accordance with the invention, a print head assembly for use with a temperature sensitive impression medium in a dot-matrix line printer, meeting the above-stated goal without causing excessive heating of the print head housing, comprises a housing having a front and a rear end and a floor extended therebetween; a plurality of electrically actuatable means for impinging upon the impression material; means for guiding the plurality of impinging means to form a straight line at the housing front end and adjacent the impression material; and electrical means positioned within the housing for heating the impinging means without interfering with their movement through the front housing end, the heating assembly being insulated from the housing to prevent excessive heating thereof.

In a preferred embodiment of this novel print head assembly, a heating element assembly is installed in the housing between wire guide means for maintaining the plurality of print wires along an imaginary straight line and a jewel bearing positioned in the front housing end to maintain the linear relationship between the plurality of print wires. The heating assembly comprises two cartridge-type electrical heating elements arranged on opposite sides of a guideway to permit unimpeded reciprocating movement of the print wires. The elements are encased on four sides with an insulating material to prevent excessive heat from being conducted to the print head housing. The heating elements heat the enclosed portion of the print wires to a temperature of the order of 500° F., whereby the print wire tips extended through the jewel bearing are maintained at approximately 300° F. — a temperature sufficient to impress a suitably contrasting dot upon heat-activated paper. The heating elements are preferably energized whenever the printer motor is energized, to alleviate any required additional heat-up time prior to printing and insure the print wires being maintained at a steady-state temperature.

It is therefore one object of the present invention to provide a print head assembly capable of causing impressions upon a thermal impression medium.

Another object of the invention is to maintain print wires in the print head assembly at a temperature sufficient to raise a high contrast dot on a thermal impression medium.

It is still another object to maintain the print wires at an elevated temperature without excessively heating the print head assembly housing.

It is a further object to heat the plurality of print wires with a small heating assembly which does not interfere with print wire movement.

The above as well as other objects of the invention will become apparent from the following description of the accompanying drawings.

DETAILED DESCRIPTION OF THE INVENTION

Figures 1, 2:
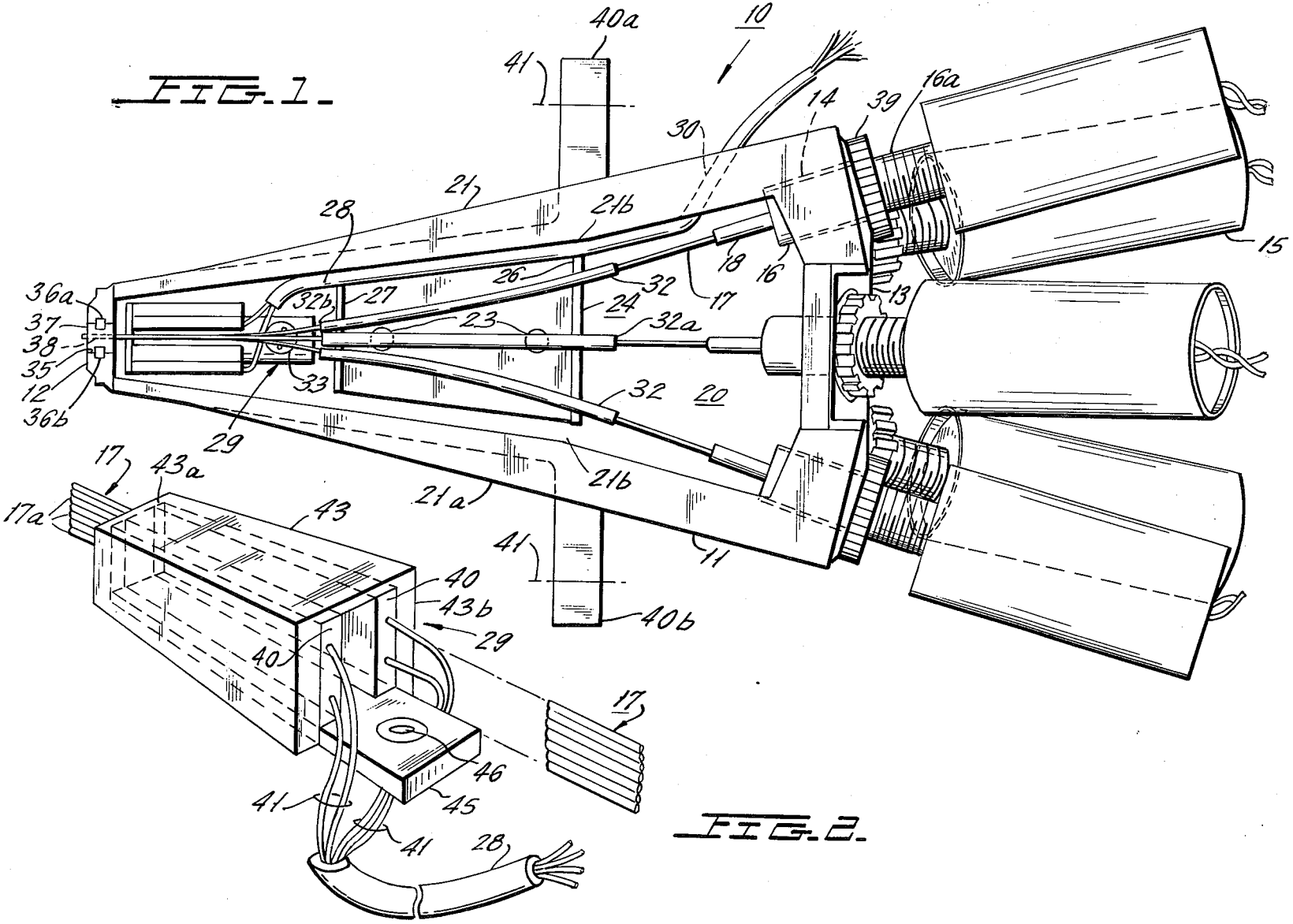
FIG. 1 is a plan view of a thermal print head assembly in accordance with the invention.
FIG. 2 is a perspective view of the heating element assembly utilized in accordance with the invention to maintain the temperature of the print wire tips.

Referring now to the figures, thermal print head assembly 10 is comprised of a hollow housing 11 having a front wall 12 and a rear wall 13 provided with a plurality of tapped openings 14. A plurality of electrically actuatable solenoids 15 include a core stem 16 extended from one end of the solenoid and a thin, flexible print wire 17 slidably engaged and supported by a non-ferrous guide tube 18 installed within the bore of core stem 16. Cylindrical core stem 16 is threaded at 16a to threadedly engage the tapped aperture 14 in rear wall 12.

Housing 11 further includes a floor 20 and a pair of upright side walls 21, 21a extending between front wall 12 and rear wall 13. A pair of projections 23 extend upwardly from floor 20 for positioning and securing a generally U-shaped wire guide assembly 24 essentially midway between the sidewalls **21, 21*a***.

The flat upright arms 26 and 27 of tube guide assembly 24 are of differing widths, as necessitated by the tapered side walls **21, 21*a* which taper toward front wall 12. It should be understood that the width of each arm 26 and 27 may vary over a range limited only by the maximum width necessary for proper wire guidance as hereinafter described; arms 26 and 27 must fit between sidewall interior surfaces 21***b* and leave a sufficient distance between one of said side walls and an end of each wire guide assembly arm for the passage of a multi-wire electrical cable 28 extending from heater assembly 29 along one sidewall interior surface 21*b*, thence through that same side wall via a passageway 30, the use of multi-conductor cable 28 more fully explained hereinafter. The minimum width of each arm 26 and 27 is established as that arm width necessary to hold each of a plurality of curved wire guide tubes 32 in position to guide the associated print wire 17 toward an alignment position, in the vicinity of heater assembly attachment screw 33, whereby all of print wires 17 are arranged along a substantially vertical straight line (as best seen in FIG. 2). The tube guides 32 converge toward the forward end of housing 11. The interior walls of the hollow elongated wire guide tubes 32 are preferably lubricated to reduce wear.

Each solenoid 15 is positioned and attached to body portion 11 by initially inserting each print wire tip 17*a* through its associated rear wall aperture 14, then moving print wire tip 17*a* into the first end 32*a* and through the bore of the associated print wire guide tube 32, until print wire tip 17*a* emerges from the bore at the opposite end 32*b* of the guide tube.

Housing forward end 12 is provided with an opening 35 and a pair of guide slots 36*a* and 36*b* for receiving and positioning a jewel bearing 37 having a plurality of vertically aligned openings 38 therein for receiving each of print wires therethrough. Each solenoid 15 is mounted upon rear wall 13 to align the tips of print wires 17 with the exterior surface of jewel bearing 37. The print wires are provided to have a "throw" of the order of 0.015 inches beyond the exterior surface of jeweled member 37. Core stem 16 is further provided with a lock nut 39 threadably engaged upon core stem threaded portion 16*a*.

Housing 11 is further provided with a pair of outwardly extending flanges 40*a* and 40*b*, each having tapped openings 41 therein for threadably engaging fastening members to secure the entire print head assembly 10 to a movable carriage (not shown) forming a part of the printer for moving the print head assembly 10 along a horizontal line to successively print the dot columns which form the characters, the total number of dots per column being selectively controlled by selectively energizing a combination of solenoids 15 to cause print wire tips 17*a* to impact the heat-sensitive coating provided on the paper document (not shown) in accordance with the particular character or symbol to be printed.

The heat sensitive coating requires that print wire tips 17*a* be maintained at a temperature in the range from 270° F. to 450° F. or the preferred range of 280° F. to 350° F. In one preferred embodiment to tips 17*a* was maintained at an approximate temperature of 300° F. It is not practical to directly heat the print wire tips, as any source of heat directed thereon will simultaneously char the paper document located only milliinches away. It has been found that print wire tips 17*a* may be heated to the desired temperature by positioning the forward ends of the print wires 17 within heating assembly 29, which heating assembly, in the case of the preferred embodiment, maintains the temperature of the enclosed print wires at a temperature of the order of 500° F. by convective heat transfer. Heat energy is conducted along each print wire to the print wire tips 17*a*. While each print wire 17 may be constructed of any durable, heat-conductive material, tungsten print wires are used in a preferred embodiment.

Heating assembly 29 includes a pair of small cartridge-type heating elements 40, preferably composed of nichrome wire bonded to a metal case to yield good thermal contact. Each heating element 40 receives electrical power via a pair of insulated wires 41 connected thereto; all four insulated wires then being bundled and further insulated in multi-conductor cable 28. The heating elements 40 are spaced apart so as not to interfere with reciprocating movement of the print wires 17. Heating elements 40 are encased in a hollow member 43 of a heat insulating material. Member 43 has a generally rectangular cross-section with open opposed ends to allow print wire reciprocating movement entirely through heating assembly 29. A first open end 43*a* closely positioned adjacent the interior surface of jewel bearing 37, is of generally smaller area than is an opposite end 43*b* closest to wire guide assembly 24; the cross-sectional interior area of heating assembly 29 is gradually decreasing, as required by the convergence of side wall interior surfaces 21*b*. The wall of hollow member 43 adjacent the interior surface of floor 20 is provided with an extended portion 45 having an aperture 46 for receiving means 33 to fasten the heating assembly 29 to floor 20. Multi-conductor cable 28, as previously described, is positioned abutting side wall interior surface 21*b*, through slot 30, which is filled with a suitable epoxy after cable 28 has been inserted therethrough, and thence to a source of electrical power (not shown) for energizing heating elements 40. In a preferred embodiment, the printer motor (not shown) and the heating elements are connected to the same power source, to be simultaneously energized when the printer is turned on, whereby sufficient time elapses for heating elements 40 to stabilize the elevated temperature of print wires 17, thus reducing the required warm-up time before the printer can be used.

There has just been described a novel thermal print head assembly for use with a temperature-sensitive impression material in a dot-matrix type line printer elmininating the need for an inked ribbon and its attendant guide mechanism, while allowing the print wire tips to be maintained at a sufficiently high temperature to form a high contrast dot on the thermal impression material responsive to each activation of each print wire driving solenoid.

The present invention has been described in connection with one preferred embodiment thereof, many variations and modifications will now become apparent to those skilled in the art. It is preferred, therefore, that the present invention be limited not by the specific disclosure herein, but only by the appended claims.

What is claimed is:

1. A print head assembly for use with a temperature sensitive impression material in a dot-matrix line printer, comprising:

a housing having a rear wall and a front wall joined by a pair of side walls, said housing front wall having an aperture;

a plurality of flexible elongated reciprocally mounted print wires, each print wire having a first and a second end;

bearing means maintained in said front wall for slidably supporting the first ends of said print wires and maintaining said print wires in a spaced linear fashion;

solenoid means mounted upon said rear wall and being coupled to each said print wire second end for temporarily selectively outwardly displacing each said print wire first end away from an exterior surface of said front wall upon energization of said solenoid means, said solenoid means each including spring means for returning the print wire to a rest position upon deenergization of the solenoid means;

first means positioned within said housing and between said housing front and rear walls for aligning and guiding the intermediate portions of said print wires whereby said print wires converge toward said front wall; and means spaced from and substantially surrounding said print wires for heating the forward portion of said print wires to a predetermined temperature, whereby said print wire first end is heated by conduction and maintained at a sufficient temperature to activate said heat sensitive impression material in the event said print wire movement means is energized to move said print wire first end to momentarily impinge upon said impression material.

2. A thermal print head assembly as set forth in claim 1, wherein said heating means is of an electrical heating element; and further including means adapted to couple said electrical heating element to a source of electrical energy.

3. A thermal print head assembly as set forth in claim 1, wherein said heating means includes at least one elongated heating element positioned to one side of said print wires and means formed about said heating element for thermally insulating said housing from said heating element.

4. A thermal print head assembly as set forth in claim 3, wherein said heating element comprises a pair of heating element portions of generally rectangular shape, said heating element portions being positioned on opposite sides of said print wires and being spaced therefrom a distance sufficient to permit unimpeded reciprocating movement of said print wires therebetween; and said thermal insulating means surrounding said pair of heating element portions and being attached to opposed exterior wall surfaces thereof.

5. A thermal print head assembly as set forth in claim 3, wherein said heating element further comprises a nichrome heating wire bonded to a metallic backing member to insure good thermal conductivity.

6. A thermal print head assembly as set forth in claim 1, wherein said thermal heating means includes means for maintaining the temperature of said print wire portions enclosed by said heating means at a level sufficient to maintain the print wire first ends at a sufficient temperature to form dots on the thermally treated paper when impacted by a print wire.

7. A thermal print head assembly as set forth in claim 6, wherein said maintaining means is adapted to maintain said print wire first end at a temperature between 270° F. and 450° F.

8. A thermal print head assembly as set forth in claim 6, wherein said maintaining means is adapted to maintain said print wire end at a temperature between 285° F. and 350° F.

9. A thermal print head assembly as set forth in claim 8, wherein each said print wire is composed of a tungsten alloy, whereby high heat conductivity is established within said print wire while maintaining a high degree of print wire durability.

10. A thermal print head assembly as set forth in claim 1, further including means surrounding said heating means for thermally insulating said housing from said heating means.

* * * * *